United States Patent [19]

Bergamin

[11] Patent Number: 4,480,886

[45] Date of Patent: Nov. 6, 1984

[54] QUICK CONNECTOR FOR A MULTI-CONDUCTOR CIRCUIT

[75] Inventor: Vito Bergamin, Padua, Italy

[73] Assignee: Zetronic S.p.A., Padua, Italy

[21] Appl. No.: 462,439

[22] Filed: Jan. 31, 1983

[30] Foreign Application Priority Data

Mar. 2, 1982 [IT] Italy ..... 84110 A/82

[51] Int. Cl.[3] ..... H01R 9/09

[52] U.S. Cl. ..... 339/75 MP; 339/176 MF; 339/176 MP

[58] Field of Search ..... 339/75 M, 75 MP, 176 M, 339/176 MP

[56] References Cited

U.S. PATENT DOCUMENTS

| | | | |
|---|---|---|---|
| 2,875,425 | 2/1959 | Gilbert | 339/176 MP |
| 3,329,926 | 7/1967 | Aksu et al. | 339/75 MP |
| 3,750,085 | 7/1973 | Cooper | 339/75 M |
| 3,753,211 | 8/1973 | Pauza et al. | 339/75 MP |
| 3,883,207 | 5/1975 | Tomkiewicz | 339/75 M |
| 4,189,199 | 2/1980 | Grau | 339/75 MP |
| 4,204,737 | 5/1980 | Faber et al. | 339/176 MP |

FOREIGN PATENT DOCUMENTS

| | | | |
|---|---|---|---|
| 885040 | 12/1961 | United Kingdom | 339/75 MP |
| 2058491 | 4/1981 | United Kingdom | 339/75 M |

*Primary Examiner*—John McQuade

*Attorney, Agent, or Firm*—D. Paul Weaver

[57] ABSTRACT

A connector for a multi-conductor circuit is disclosed which includes a base having a longitudinal cavity defining a plurality of seats whose spacing is equal to the distance between the centers of the conductors of a multi-conductor circuit. Pairs of springs, one pair for each seat, are connected to prongs emerging from the base, at least one spring of each pair being resiliently displaceable toward the other spring. A cover insertable into the cavity of the base includes a central longitudinal slot bounded by two resilient ledges through which a multi-conductor circuit is introduced. The ledges of the cover approach each other on insertion of the cover into the base and clamp the sheath of the multi-conductor circuit, at least one of the ledges having an extension for displacing one spring of each pair toward the opposing spring.

16 Claims, 8 Drawing Figures

QUICK CONNECTOR FOR A MULTI-CONDUCTOR CIRCUIT

BACKGROUND OF THE INVENTION

The present invention relates to a quick connector for a multi-conductor circuit. Quick connectors for multi-conductor circuits, both in the form of flexible printed circuits and flexible multi-core cables, are known. A known type of connector for flexible printed circuits includes a longitudinally hollow parallelepiped base having a plurality of side-by-side seats whose center-to-center distances equal the distances between centers of the printed circuit tracks. Each seat includes an electrical contact which extends below the base in the form of a terminal for connection to the printed circuit board to which the connector is fitted. In order to clamp the flexible printed circuit to the connector, the stripped end of the printed circuit is inserted into the longitudinal cavity of the base, and is then locked by the insertion of a cover which performs the dual function of mechanically locking the printed circuit to the connector, and of laterally pressing its tracks against the contacts located in the various seats. The positioning of the cover relative to the base or block is made secure by snap projections present on the former and engageable with coacting recesses in the latter.

In the above known connector, electrical contact between the printed circuit tracks and the contacts of the seats is insured by the spring configuration of the contacts, and mechanical locking against pulling is insured by teeth provided on the cover and engaging in holes in the printed circuit.

One drawback of this known connector is that the mechanical locking system is suitable only for flexible printed circuits, but not for multi-core cables.

A further drawback of this known connector is that each locking hole leads to the loss of one track of the printed circuit with the necessity to over-dimension it in order to insure the same capacity.

To overcome these limitations, it has been proposed to use special clamping devices by which mechanical locking is provided by the same elements which insure the electrical contact. These devices, which are suitable for the quick connection of both flexible printed circuits and multi-core cables, provided that the stripped ends of the latter are previously tinned, are of poor reliability because the mechanical locking elements can cut into or damage the electrical conductors.

If the conductor cover is hinged to the base, complete access to the inner longitudinal cavity of the base by the multi-conductor circuit requires the total opening of the cover, and consequently an overlying working space of sufficient height. Moreover, as the multi-conductor circuit leaves the connector "sideways" to the cover, the connector must be previously positioned in the board, this requiring special care during assembly.

A connector is also known having bores into which the previously tinned ends of conductors of a multi-conductor circuit are inserted, the ends then being immediately locked in position by a wedge cover. Again, in this case, each seat comprises an electrical contact which extends to the outside in the form of a prong or terminal to be soldered to the printed circuit board. One drawback of this connector is that each conductor is locked in its seat in a position corresponding with its sheath, and this does not insure perfect electrical connection, which is made even more uncertain by the fact that the contact is not of the self-cleaning type.

Another drawback is that the wedge clamping system requires a certain insertion force to produce mechanical locking, this requiring application of a large force to later disengage and separate the connector.

A further drawback is that the metal parts, conductor and contact, are pressed together by a rigid body which tends to make electrical contact uncertain, and is poorly adaptable to conductors of different sizes.

Finally, as in the case of the preceding connector, this last-discussed connector also requires the multi-conductor circuit connected to it to be positioned sideways, thus requiring its positioning relative to the printed circuit board.

Accordingly, the object of this invention is to obviate all of these drawbacks of the prior art, and effect a quick connection of the multi-conductor circuit without insertion force, with high electrical contact reliability independently of conductor diameter, and with secure locking against pulling and without restriction of its positioning on the printed circuit board.

This objective is attained according to the invention by a multi-conductor circuit connector which comprises:

a parallelepiped base provided with a longitudinal cavity divided into a plurality of seats of which the distance between centers is equal to the distance between centers of the conductors of the multi-conductor circuit;

a pair of springs for each seat connected to a terminal emerging from said base, at least one of the springs being elastically displaceable toward the other;

a cover snap-insertable into the longitudinal cavity of the base and provided for the introduction of the multi-conductor circuit with a central longitudinal slot bounded by two elastically yieldable ledges which approach each other on insertion of the cover into the base, and are arranged to retain the sheath of the multi-conductor circuit by clamping force, at least one of said ledges having means to cause the corresponding set of springs to approach the imposing set of springs of the connector.

DETAILED DESCRIPTION

Figure 1:
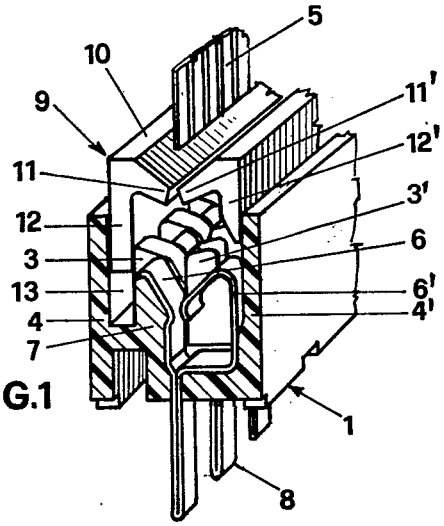
FIG. 1 is a fragmentary perspective view in cross section of a connector according to the invention for a flexible printed circuit, in the position ready for the insertion of the latter.

Referring to the drawings in detail wherein like numerals designate like parts, the connector according to the invention is used for multi-conductor circuits, such as flexible printed circuits or multi-core cables and is of the type known in the art as zero insertion force (ZIF), in that it requires no force to insert the multi-conductor circuit into the connector.

The connector shown in FIGS. 1–6 comprises a parallelepiped base 1 having an internal longitudinal cavity divided into a plurality of side-by-side seats 2. The center distances between the seats 2 is equal to the distance normally adopted by multi-conductor circuits. The seats 2 are separated from each other by pairs of baffles 3, 3', which extend inwardly from the opposing longitudinal walls 4, 4' of the base 1, and terminate before reaching the longitudinal center line of the base, to enable a flexible printed circuit 5 to be inserted. The upper edge of each baffle 3, 3' is slightly inclined and its lowest point is near the center line of the longitudinal cavity running through the base 1.

Each seat 2 has a pair of metal springs 6, 6', one of which rests against a shoulder 7 of the seat, while the other spring is slightly spaced from the adjacent longitudinal wall 4'. Both of the springs 6, 6' are joined together at the bottom of the base 1 and emerge downwardly to form depending prongs or terminals 8.

The connector further comprises a clamping cover 9 snap-insertable into the longitudinal cavity of the base 1. This cover comprises a substantially hollow parallelepiped frame 10 having two longitudinal ledges 11, 11' which extend inwardly from its sides. The ledges are slightly inclined downwardly, and their lower surfaces have slightly greater inclination than that of the upper faces of baffles 3, 3'.

Figure 2:
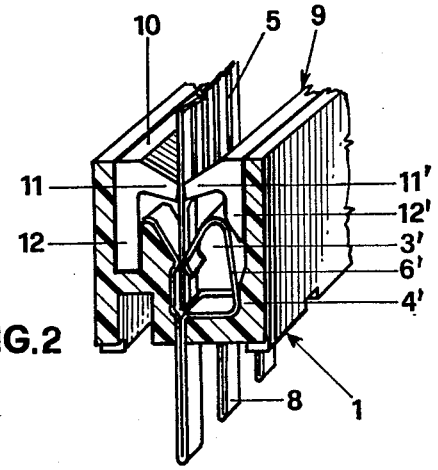
FIG. 2 is a view similar to FIG. 1 showing the flexible printed circuit in its inserted clamped position.

The longitudinal side 12 of the cover 9 disposed on the same side of the connector as the baffles 3 is housed as a close fit in a longitudinal guide slot 13 provided between the wall 4 and baffles 3. The opposite longitudinal side 12' of the cover has its lower edge beveled as shown to enable it to be inserted between springs 6' and the adjacent longitudinal wall 4' of base 1. This engagement causes the springs 6' to be elastically urged toward the opposing springs 6, as best shown in FIG. 2.

The cover 9 is provided at its ends with two elements 14 for snap connection to base 1. Each element 14 is connected at its top to the transverse sides of the frame 10 by a portion forming an elastic hinge. Each element 14 has a vertical slot 15, at the lower end of which rests under restrained conditions a lug 16 fixed on each end wall 17 of the base 1.

Additionally, each element 14 is provided with a pair of elastic strips 18 which, when at rest, diverge upwardly and are arranged to coact at their free ends with projections 19 on the longitudinal walls 4, 4' of the base.

Figure 4:
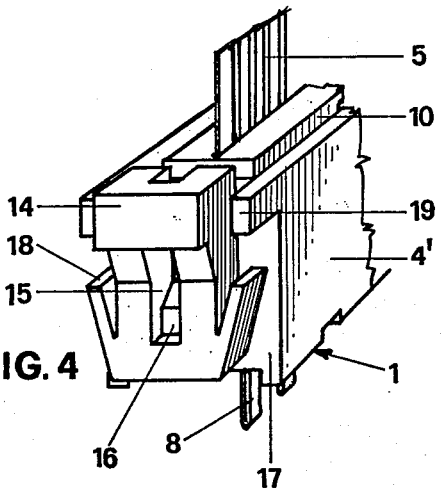
FIG. 4 is a similar view of the connector as shown in FIG. 2.

The operation of the connector according to the invention is as follows:

After removing any protective varnish from the end of flexible printed circuit 5, the latter is inserted without any force into the longitudinal slot of cover 9 defined by the two parallel ledges 11, 11', and the cover is then pressed downwardly in the cavity of the base. During this stage, the two ledges 11, 11' rest on the upper inclined edges of the baffles 3, 3' and bend slightly upwardly due to the described different inclination thereof. The two ledges 11, 11', by virtue of the approach of their opposing edges, securely lock the printed circuit 5 by clamping action. Simultaneously, the lower beveled wall 12' of the cover 9 is inserted between the springs 6' and the wall 4' of the base, causing the spring 6' to yield and approach the opposing springs 6, thereby establishing solid electrical contact with the printed circuit tracks. The stable locked position of the connector, FIGS. 2 and 4, is maintained by the engagement of the lower ends of slots 15 with the coacting lugs 16.

In order to release the printed circuit 5 from the connector, it is only necessary to raise the cover 9 from the base 1. This is done by pressing laterally against the connection elements 14 at their tops to release the slots 15 from the lugs 16, after which the cover is pulled lightly upwardly. The cover 9, on rising, causes the ledges 11, 11' to return to their initial relaxed positions, thus disengaging the printed circuit 5. Simultaneously, the springs 6', no longer being urged by the wall 12', withdraw from the opposing springs 6 and the latter also withdraw from the printed circuit tracks. The rising movement of the cover 9 stops, FIG. 3, when the tops of the elastic strips 18 engage the extensions 19, thus preventing total separation of the cover from the base.

Figure 3:
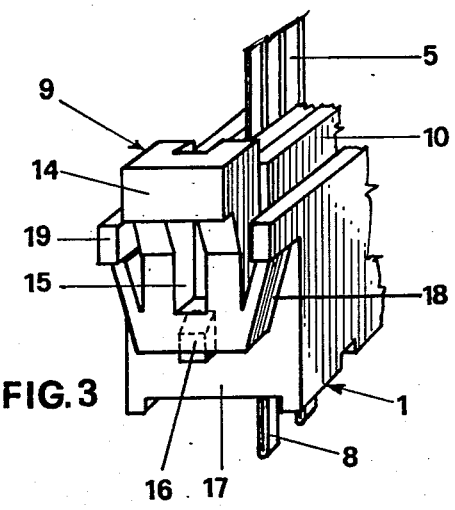
FIG. 3 is a partial end perspective view of the connector as shown in FIG. 1.
Figure 5:
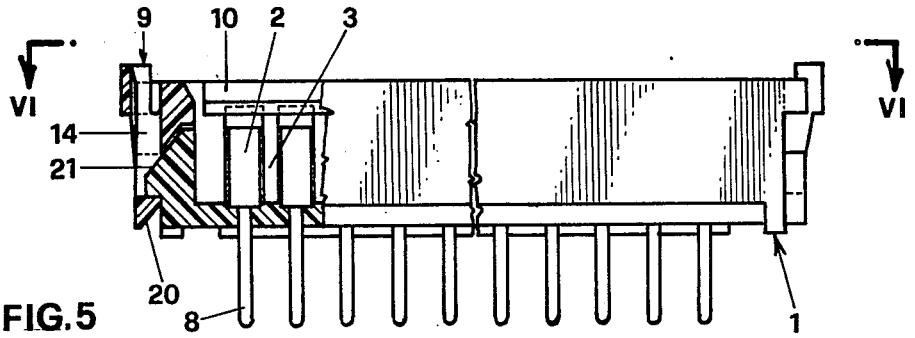
FIG. 5 is a fragmentary side elevation, partly in section, of the connector as shown in FIGS. 2 and 4.
Figure 6:
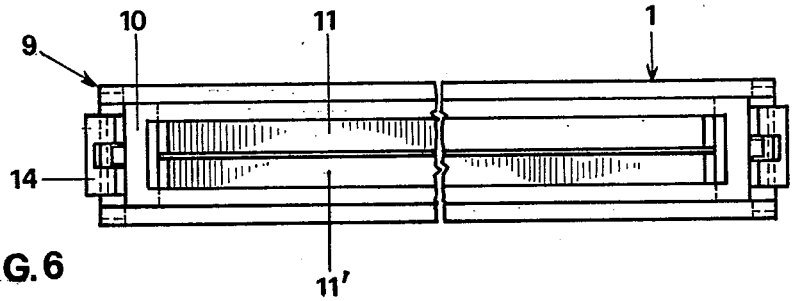
FIG. 6 is a plan view taken on line VI—VI of FIG. 5.

From the foregoing, it should be apparent that the connector in FIGS. 1 through 6 offers a number of advantages over the prior art, in particular:

it assures stable mechanical locking of the printed circuit 5 against vibration and pulling in a region other than the electrical contact region, the former in fact corresponding to the ledges 11, 11' and the latter corresponding to the springs 6, 6';

if subjected to pulling, the connector exerts progressively increased clamping action on the printed circuit as the degree of pull increases;

the cover 9 remains connected to the base 1 even in the disengaged position, FIGS. 1 and 3, assuring permanent availability of the complete connector;

it is symmetrical, and therefore can be mounted on the printed circuit board without prior orientation;

it provides very high reliability since the electrical contacts are of the self-cleaning type. Moreover, because the contacts are resilient, they can adapt readily to printed circuits of different thicknesses. Finally, they are double, and adaptable to any printed circuit regardless of which of its surfaces carry the tracks;

when in the disengaged condition, the cover is held raised from the base by virtue of the spring contacts and cooperative inclined surfaces 20, 21 present on the connection elements 14 and lugs 16, respectively, FIG. 5. As a result, no insertion force is required to place the printed circuit in the connector, and the connector is a true ZIF type;

it is extremely simple to disengage, requiring only a slight pressure on the end elements 14. The lifting of the cover 9 is facilitated by the elastic reaction of the ledges 11, 11' and springs 6, 6'.

Figure 7:
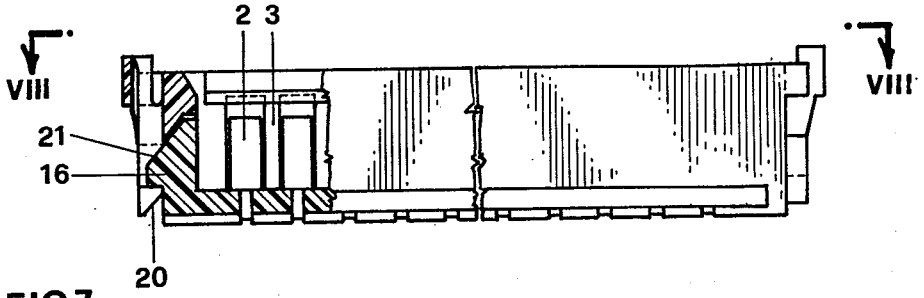
FIG. 7 is a view similar to FIG. 5 showing a modified embodiment of the connector for a multi-core cable.
Figure 8:
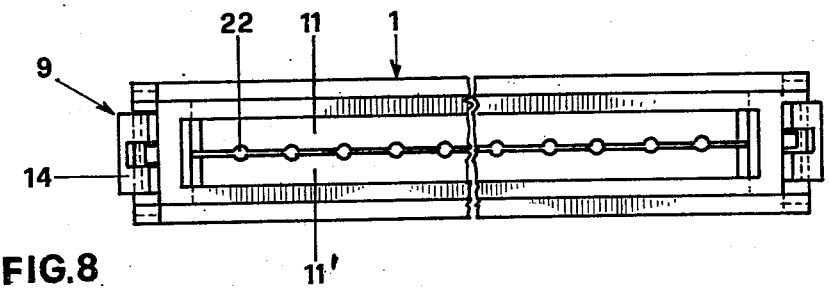
FIG. 8 is a plan view of the connector taken on line VIII—VIII of FIG. 7.

In the embodiment of the invention shown in FIGS. 7 and 8, a connector is provided for multi-core cables rather than for printed circuits. It differs from the prior embodiment by the presence of semi-circular recesses 22, FIG. 8, on the opposing ledges 11, 11' of the cover, and possibly on the springs 6, 6'. The recesses 22 embrace the sheaths of individual conductors with clamping force, whereas any recesses present in the springs 6, 6' improve electrical contact with the conductors of the multi-core cable. A further difference from the prior embodiment is that the baffles 3, 3' are in contact and completely close the seats or compartments 2, because, in the case of a multi-core cable, the individual conductors can be separated each from the other at their ends.

In the embodiment shown by FIG. 7, the prongs or terminals 8 of the prior embodiment are not visible because they may emerge parallel to the bottom of the base 1 instead of perpendicular thereto.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A quick connector for a multi-conductor circuit comprising a base member having a longitudinal cavity divided into a plurality of seats whose center distances equal the center distances of conductors in a multi-conductor circuit, a pair of opposing springs for each seat connected to a common terminal emerging from the base member, at least one spring of each pair being yieldingly displaceable toward the other spring, and a cover insertable into the longitudinal cavity of the base member and having opposing resilient ledges defining a longitudinal slot through which a multi-conductor circuit may be introduced into the connector without force, said resilient ledges approaching each other during insertion of the cover into the cavity of the base member and retaining the multi-conductor circuit by clamping action, and means on at least one of said ledges engaging one corresponding spring of each pair and causing it to yieldingly approach the other spring of each pair.

2. A quick connector for a multi-conductor circuit as defined in claim 1, and said plurality of seats of the longitudinal cavity being separated by baffles whose top edges are inclined from the side walls of the cavity toward its center, said ledges being correspondingly inclined to a slightly greater degree than the tops of the baffles, whereby the ledges of the cover are bent upwardly when the cover is inserted into the cavity of the base member thereby causing the opposing edges of the ledges to exert a clamping force on the inserted multi-conductor circuit.

3. A quick connector for a multi-conductor circuit as defined in claim 1, and one spring of each opposing pair in each seat being spaced from the adjacent side wall surface of the seat.

4. A quick connector for a multi-conductor circuit as defined in claim 3, and the other spring of each opposing pair in each seat resting against a shoulder of said seat.

5. A quick connector for a multi-conductor circuit as defined in claim 1, and said cover being formed separately from the base member and comprising a frame from the side walls of which said ledges project toward each other in opposing relationship.

6. A quick connector for a multi-conductor circuit as defined in claim 1, and said base member and cover being elongated and of approximate parallelepiped form.

7. A quick connector for a multi-conductor circuit as defined in claim 3, and the longitudinal side wall of the cover adjacent to the springs which are spaced from the corresponding wall of the cavity having a tapered extension which during insertion of the cover into the cavity of the base member enters the space between such springs and the adjacent wall of the cavity and forces the springs yieldingly toward the corresponding opposing springs of the pairs.

8. A quick connector for a multi-conductor circuit as defined in claim 7, and the longitudinal side wall of the cover opposite to the side wall having the tapered extension entering a guide slot formed in the base member when the cover is introduced into the cavity of the base member.

9. A quick connector for a multi-conductor circuit as defined in claim 5, and said cover having on its opposite ends yielding connection elements which are snap-engageable with the base member as the cover is inserted into the cavity of the base member.

10. A quick connector for a multi-conductor circuit as defined in claim 9, and each connection element and the corresponding end wall of the base member being provided respectively with a slot and retention lug which are mutually engageable.

11. A quick connector for a multi-conductor circuit as defined in claim 10, and each connection element of the cover being provided with at least one yielding strip enabling the cover to be partially separated from the base member to a sufficient extent to permit separation of the multi-conductor circuit from the connector but preventing total separation of the cover from the base member.

12. A quick connector for a multi-conductor circuit as defined in claim 10, and each connection element of the cover and each retention lug of the base member being provided with cooperative inclined faces which hold the cover in a state of disengagement from the base member.

13. A quick connector for a multi-conductor circuit as defined in claim 1, and each seat being bounded by the longitudinal side walls of the base member and by a pair of baffles extending transversely to said longitudinal side walls, the opposing end faces of the baffles being separated on the longitudinal center line of the base member to allow introduction of the multi-conductor circuit into the connector.

14. A quick connector for a multi-conductor circuit as defined in claim 1, and each seat being bounded by the two longitudinal side walls of the base member and by continuous transverse walls which connect the longitudinal walls together.

15. A quick connector for a multi-conductor circuit as defined in claim 14, and the opposing surfaces of said ledges at positions registering with said seats having substantially semi-circular recesses which are substantially complementary to the sheaths of individual conductors of a multi-core cable.

16. A quick connector for a multi-conductor circuit as defined in claim 15, and said springs having substantially semi-circular cavities in their opposing faces which are substantially complementary to the individual conductors of a multi-core cable.

* * * * *